United States Patent [19]

DeForrest, Sr.

[11] Patent Number: 4,852,920

[45] Date of Patent: Aug. 1, 1989

[54] SELF PROTECTING HASP

[76] Inventor: William DeForrest, Sr., 1825 Via Burton, Anaheim, Calif. 92806

[21] Appl. No.: 79,346

[22] Filed: Jul. 30, 1987

[51] Int. Cl.[4] ..... E05C 19/08

[52] U.S. Cl. ..... 292/205; 70/56; 292/281

[58] Field of Search ..... 70/54–56, 70/2; 292/205, 281–284

[56] References Cited

U.S. PATENT DOCUMENTS

| | | | |
|---|---|---|---|
| 160,723 | 3/1875 | Smith et al. . | |
| 688,747 | 12/1901 | McMillen | 292/281 |
| 1,244,404 | 10/1917 | Ankovitz | 70/56 |
| 1,452,211 | 4/1923 | Myers | 292/205 |
| 2,584,575 | 2/1952 | Goldwasser | 292/205 X |
| 2,825,218 | 3/1958 | O'Brien | 292/283 |
| 3,572,062 | 3/1971 | Beebe | 292/205 X |
| 3,590,607 | 7/1971 | Beaver | 70/56 |
| 3,718,014 | 2/1973 | Delgadillo | 70/56 |
| 3,800,570 | 4/1974 | Kaplan | 70/54 X |
| 3,838,586 | 10/1974 | Tennison | 70/56 |
| 3,884,057 | 5/1975 | Maurer | 70/54 X |
| 3,953,062 | 4/1976 | Maston | 292/57 |
| 4,033,155 | 7/1977 | DeLucia | 70/56 |
| 4,106,315 | 8/1978 | Dohanyos | 70/56 |
| 4,113,291 | 9/1978 | Cameron | 292/281 X |
| 4,282,995 | 8/1981 | Austin | 70/54 X |
| 4,322,102 | 3/1982 | Lindblom | 70/56 X |
| 4,380,160 | 4/1983 | Hoffman | 70/56 X |
| 4,535,612 | 8/1985 | Seremet | 70/56 |
| 4,566,296 | 1/1986 | Kochakis | 70/56 |

FOREIGN PATENT DOCUMENTS

| | | | |
|---|---|---|---|
| 857594 | 12/1970 | Canada | 70/56 |
| 103308 | 2/1964 | Norway | 70/56 |
| 203530 | 9/1923 | United Kingdom | 70/55 |
| 2185519 | 7/1987 | United Kingdom | 70/54 |

*Primary Examiner*—Lloyd A. Gall

*Attorney, Agent, or Firm*—Herb Boswell

[57] ABSTRACT

A self protecting hasp for use with a padlock includes a standard eye attached to an eye plate. Further it includes a latch which has a flap which is hinged to an appropriate hinge plate. The flap includes a slot which allows for positioning of the flap onto the eye. The self protecting hasps of the invention include an inhibiting member which fits over at least that portion of the flap wherein the slot is located. The inhibiting member prevents access to the slot and the eye projecting thereto and any padlock locked through the eye. Further a latch eye can connect to the cover member and project towards the slot whereby it will lay adjacent to the eye. This allows the latch eye to also be engaged by a shank of a padlock which is passed through the eye. This fixedly secures the cover member over the flap to prevent prying and other forceful unauthorized access to the area of the hasp beneath the cover member.

14 Claims, 3 Drawing Sheets

96
90
92
94
98
100
102
104

96
90
98
92
104
100

106
134
126
132
136
112
110
120
114
116
118

112
122
124
108
110
114
128
130

SELF PROTECTING HASP

BACKGROUND OF INVENTION

This invention is directed to a self protecting hasp which includes an inhibiting element for inhibition of severing the shank of a padlock utilized in conjunction with the hasp.

Hasps are highly utilitarian structures for connecting and locking two elements together such as locking a gate, a door, a cupboard, a drawer or the like. The common hasp has two main parts. The first part constitutes the latch portion. It is made up of a hinge plate which is hinged to a flap. The hinge plate has appropriate openings in it allowing it to be attached to a structure via screws, bolts or the like. The flap includes a slot.

The second portion of the common hasp is an "eye." This is sometimes referred to as a swivel or a staple. For the purposes of this specification it will be referred to as an eye. The eye includes an eye plate which also has appropriate openings for attachment of this plate to the other portion of the structure which is to be secured via the hasp.

The hinge portion is located with respect to the flap such that the flap folds over the screw heads or the like which are utilized to connect the components to a structure. The slot fits over the eye with the eye protruding through the slot. When the slot fits over the eye the flap also covers the screw heads or the like which are utilized to connect the eye plate. The shank of a padlock can then be passed through the eye and the padlock locked. This fixes the flap to the eye such that the two components to which the hasp is attached are locked together.

In a modification of the above structure, the eye is constructed as a swivel allowing it to be rotated on the eye plate or swivel plate. It is lined up with the slot when the flap is first attached to the eye and then it is rotated 90° and thus serves as a latch to hold the flap to the eye. A lock then can be passed through the swivel to lock the structure.

When locked with a padlock, in both of the above embodiments of common hasps an unauthorized person cannot remove the hasp from the structure which it is attached to because the flap covers the screw heads or bolt heads or the like utilized to attach both the latch and the eye to the structure. However, the shank of a padlock used to lock the hasp is exposed and an unauthorized person can use a pair of bolt cutters and simply snip the padlock shank. This allows for easy removal of the padlock from the hasp followed by opening of the hasp to gain access to the structure which was being secured with the hasp and padlock.

In order to increase the security of a hasp, measures have been taken to better conceal the screw heads, bolt heads or the like utilized to connect the components of the hasp to a structure. Further, the components of the hasp have been case hardened such that they cannot be bent or pried loose from the structure on which the hasp is attached. While both of these expedients certainly help to better secure the hasp to the structure, they still leave the combination of the hasp and padlock exposed to the use of bolt cutters to sever the padlock shank. Thus, irrespective of whatever expedients were taken to strengthen the hasp or the mounting of a hasp to the structure the combination of the hasp and padlock heretofore was always susceptible to unauthorized entry into the structure because of the exposure of the padlock shank.

BRIEF DESCRIPTION OF THE INVENTION

In view of the above it is a broad object of this invention to provide a self protecting hasp which includes components on the hasp which provide for security against severing of a padlock shank by bolt cutters. It is a further object of this invention to provide for self protecting hasps which are easily and conveniently manufactured and thus are economical to the consumer but which still provide for increased security of the padlock shank of a padlock utilized to secure the hasp.

These and other objects as will become evident from the remainder of this specification are achieved in a self protecting hasp for use with a padlock which includes an eye and means for attaching the eye to a structure. The self protecting hasp further includes a latch for engaging with the eye. The latch has a hinge portion for attaching the latch to a structure. The latch further includes a flap having a slot means in the flap for engaging with the eye. The flap is movably connected to the hinge portion for manipulation of the device. The latch further includes inhibiting means for inhibiting access to a padlock which is engaged on the hasp. The inhibiting means is operatively associated with the flap and is positioned in association with the flap to inhibit access to a padlock shank which is utilized to secure the hasp.

The inhibiting means can include a cover means which is located in association with the flap and extends from the flap. The cover means is associated with the flap to cover the portion of the flap which includes the slot means. Further, the inhibiting means can include a latch eye means which is located on the latch in operative association with both the cover means and the slot means. By being so located the latch eye means is positioned to be located adjacent to the eye when the latch is engaged with the eye allowing for a padlock shank to pass through both the latch eye means and the eye to secure these two together.

The cover means can include a cover member which has a first portion thereof which is integrally formed with or attached to the flap and projects outwardly from the flap. The cover would include a second portion thereof which extends from the first portion and is located essentially parallel with the portion of the flap wherein the slot means is located. When the flap is engaged with the eye the eye having been passed through the slot means the second portion of the cover member would overlay both the eye and the slot means.

The latch eye means can include a latch eye which is located in association with the second section of the cover member and extends from that section of the cover member down toward the flap and the slot means located therein. As so positioned and located this latch eye would align itself with the eye when the flap was passed over the eye and the eye extended through the slot in the flap.

As described above the latch eye means comprises one embodiment of a cover means retaining means. Such a cover means retaining means would maintain the cover means in a fixed position with respect to the flap. In a further embodiment of the cover means retaining means, the cover member would include a further section connecting between the second section and the flap. Thus the second section of the flap of the cover member is attached to the flap via the first section and the further section. This further section can include a further slot means located therein which would be aligned with the slot means in the flap and would be engaged by the eye when the latch was attached to the eye.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the locksmithing arts will realize that these principles and/or concepts are capable of being utilized with a variety of embodiments which may differ from the exact embodiments utilized for illustrative purposes herein. For this reason this invention is not to be construed as being limited solely to the illustrative embodiments, but should only be construed in view of the claims.

DETAILED DESCRIPTION

Figure 1:
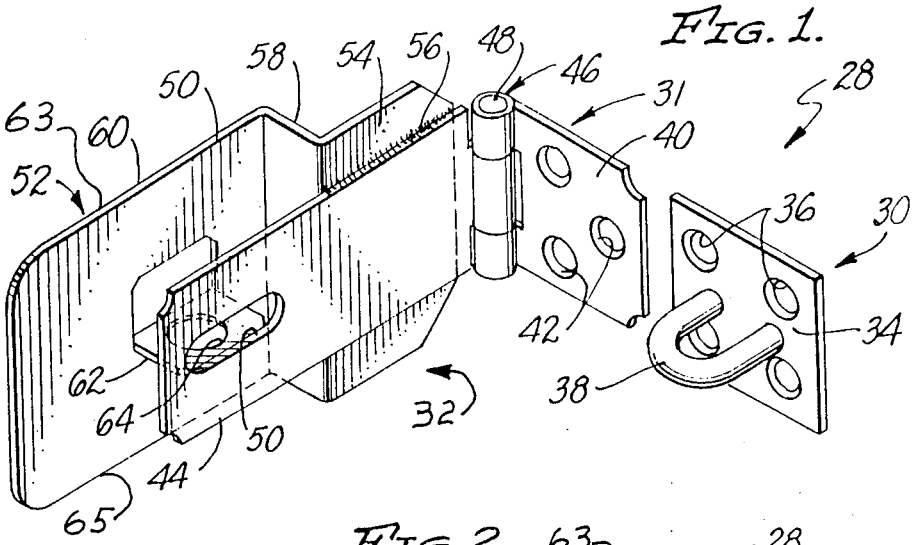
FIG. 1 is an isometric view of an embodiment of a self protecting hasp of the invention.
Figure 2:
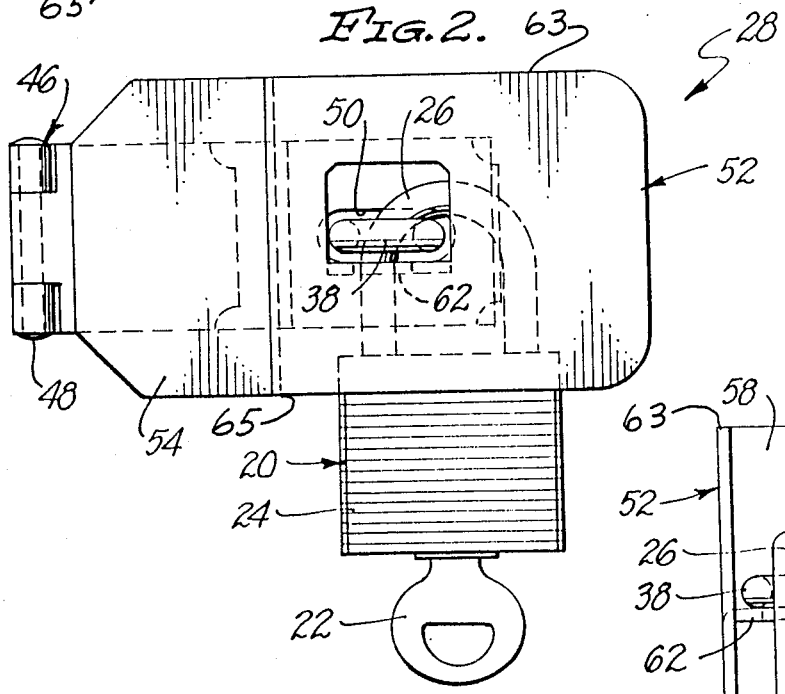
FIG. 2 is a front elevational view of the embodiment of FIG. 1.
Figure 3:
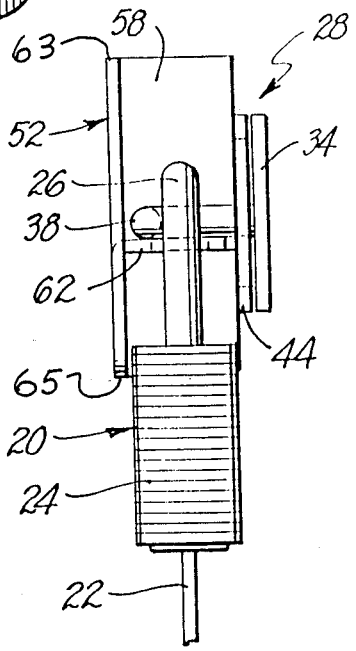
FIG. 3 is an end elevational view about the right hand side of FIG. 1.

FIGS. 1, 2 and 3 show a first embodiment of this invention. In FIGS. 2 and 3 this embodiment is shown in conjunction with a padlock 20 which, while utilized in conjunction with the self protecting hasp of this invention, does not form part of this invention. The padlock 20 would be a standard padlock which would be opened via a key 22. The padlock 20 has a body section 24 and a shank section 26. These are all as is standard in the padlock arts.

The self protecting hasp 28 of FIGS. 1, 2 and 3 has an eye portion 30 and a latch portion 32. The eye portion 30 is as is standard with other hasps. It includes an eye plate 34 having a plurality of openings 36 by which the eye plate 34 would be attached to an appropriate structure utilizing screws, bolts or the like as is standard with other hasps. Projecting from the eye plate 34 is an eye 38. The eye 38 is generally formed as a "U" shaped member which is attached to the eye plate 34 utilizing several standard expedients. The eye 38 can be case hardened if desired.

The latch portion 32 of the self protecting hasp 28 includes a hinge plate 40 also having a plurality of openings 42 by which it can be attached to a structure. Attaching to the hinge plate 40 is a flap 44. The hinge plate 40 and the flap 44 are connected together via a hinge generally depicted at the numeral 46 formed in part by certain extensions of the hinge plate 40 and certain extensions of the flap 44 in a standard manner. These are connected together via a pin 48 to complete the hinge. This is all as is standard with conventional hasps.

Further, as per conventional hasps, the flap 44 includes a slot 50. When in use as is seen in FIG. 1 the hinge palte 40 is attached to one half of the structure which it is desirous to close and the eye plate 34 is attached to the other half. The hinge plate 40 and the eye plate 44 are aligned such that the flap 44 flips back and covers the hinge plate 40 with the slot 50 engaging and passing over the eye 38 such that the flap 44 also covers the eye plate 34. This positions the eye 38 through the slot 50. In a conventional hasp a padlock shank would then be passed through the eye 38 and the padlock closed. Because the padlock shank would be located through the eye 38 one is prevented from lifting the flap 44 up over the eye 38 to disengage the hasp.

For the self protecting hasp 28 of FIGS. 1 through 3, a cover member 52 is attached to the flap 44. The cover member 52 includes a base section 54 which is attached to the flap 44 near the hinge 46 by appropriate connecting means such as the welds, collectively identified by the numeral 56. Extending from the base section 54 is a first section 58 of the cover member 52. It extends essentially perpendicular to the flap 44. A second section 60 of the cover member 52 extends essentially perpendicular from the first section 58 such that it is essentially parallel to that portion of the flap 44 where the slot 50 is located.

As is described above the cover member 50 includes two essentially 90° bends, one between the base section 54 and the first section 58 and the second between the second section 60 and the first section 58. Further, the base section 54 extends toward the hinge 46 away from the slot 50. In an alternate embodiment, not seen, the base section 54 could be bent in the opposite direction whereby it would extend toward the slot 50. Additionally, instead of having two 90° bends, a smooth curve could be formed in this alternate embodiment such that the cover member 52 would be formed in a "U" or horse shoe shape with one of its arms much longer than the other, i.e. the arm equivalent to the second section 60 would be much longer than the arm equivalent to the base section 54.

In its simplest form the above structure would serve to provide for a self protecting hasp, however, this structure can be augmented by including a latch eye 62. Without the latch eye 62 it might be possible to wedge the cover member 52 away from the flap 44 and gain access to a padlock such as padlock 20 shown attached to the self protecting hasp 28 in FIGS. 2 and 3. By providing a latch eye 62, the cover member 52 is secured by the shank 26 of a padlock 20 when the self protecting hasp 28 is closed and locked with the padlock 20.

A convenient way for providing the latch eye 62 is to punch an opening 64 in the cover member 52 intermediate side edges 63 and 65 of cover member 52. This opening will become the opening in the middle of the latch eye 62. A "U" shaped cut is now punched around this opening 64. The latch eye 62 is now bent downwardly out of plane of the cover member 52 as is seen in FIGS. 1 and 3 positioning it at a location spaced inwardly from the side edges 63 and 65 of the cover member 52.

When the latch portion 32 of the self protecting hasp 28 is closed onto the eye portion 30, the latch eye 62 aligns parallel to the eye 38. The opening 64 in the latch eye 62 is located in alignment with the open area in the eye 38. The shank 26 of the padlock 20 can then be passed through both the opening in the eye 38 of the eye plate 34 and the opening 64 in the latch eye 62. When the padlock 20 is then locked, this not only secures the flap 44 onto the eye 38 but it also secures the cover member 52 to the eye 38. Thus, it is not possible to wedge the cover member 52 away from the eye 38 and gain access to the lock shank 26 of the padlock 20.

As can be seen in FIGS. 2 and 3 when the padlock 20 is attached and locked onto the self protecting hasp 28 the shank portion 26 of the padlock 20 is completely enclosed between the bottom side of the cover member 52 and the top side of the flap 44. Note that the shank 26 is protected on the front by the cover member 52 and on the back by the flap 44. Because it is necessary to position the jaws of a bolt cutter perpendicular to the shank of a lock to cut that lock shank, it is impossible to get the jaws of a bolt cutter underneath the cover member 52 to cut through the shank 26 of the padlock 20. Aside from bolt cutters this also inhibits the use of a hacksaw or the like to defeat the security provided by the self protecting hasp 28 and the padlock 20.

Alternately to bending the latch 62 from the cover member 52 it could be formed as a separate component and welded to the inside of the cover member 52. In any event, it would project essentially perpendicular from the inside of the cover member 52 towards the slot 50 on the flap 44. If desired the latch eye 62 could also be welded to the flap 44, however, this is not necessary because the lock shank 26 secures the latch eye 62 and the cover member 52 attached there to to the eye 38 when the self protecting hasp 28 is locked with a padlock 20.

Figure 4:
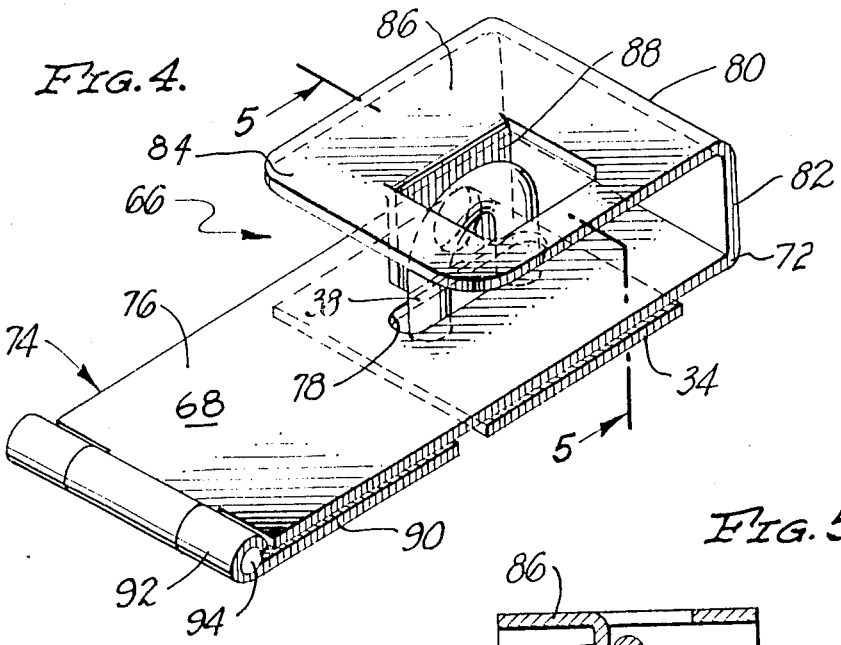
FIG. 4 is an isometric view of a further embodiment of the invention.
Figure 5:
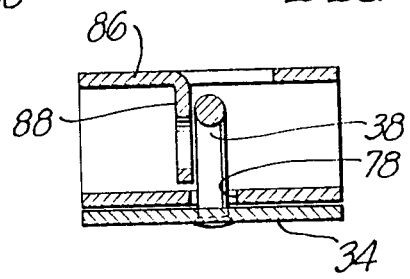
FIG. 5 is an elevational view in section about the line 5—5 of FIG. 4.
Figure 6:
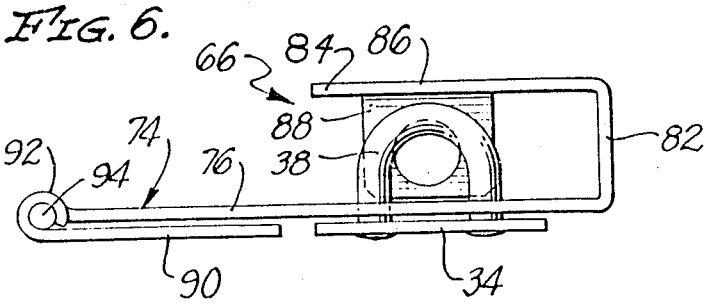
FIG. 6 is a bottom plan view of the embodiment of FIG. 4.

A further embodiment of the invention is shown in FIGS. 4, 5 and 6. Shown in these figures is a self protecting hasp 66. The eye portion of this hasp is identical to the eye portion 30 described above and as such like numerals will be utilized to identify like components. The latch portion 68, however, is slightly modified with respect to the latch portion 32 of the self protecting hasp 28.

In forming the latch portion 68 of the self protecting hasp 66 an elongated element 70 is sized such that both a flap and a cover member can be formed from it. The elongated element 70 is bent along edge 72 distal from first end 74 to form a flap portion 76. The flap portion 76 includes a slot 78. The elongated element 70 then is bent again along edge 80 to form a first portion 82 which is positioned between the two edges 72 and 80. The portion of the elongated element 70 between edge 80 and the other end 84 forms a second section 86. Because of the two bends along the edges 72 and 80 the second section 86 is essentially parallel to the flap 76.

A latch eye 88 is stamped and formed by bending as above described for the latch eye 62. As with the prior embodiment, in the embodiment of the self protecting hasp 66, the latch eye 88 is positioned so as to be located in association with the slot 78. Thus when the eye 38 from the eye portion 30 is passed through the slot 78 a padlock shank can be utilized to secure the flap portion 68 to the eye portion 30. When so secured the latch eye 88 maintains the second section or cover section 86 positioned over slot 78 and the padlock engaged therein to prevent access to the shank of the padlock.

FIG. 5 shows how the latch eye 88 is bent downwardly from the section 86 and how it is positioned in association with the slot 78 and lays essentially parallel to the eye 38 when the latch portion 68 is attached to the eye portion 30. FIG. 6 shows how the latch eye 88 aligns with the eye 38 allowing a padlock shank to be passed through to both of these members to fixedly attach and secure the second or cover section 86 of the self protecting hasp 66 to the eye 38. As with the prior embodiment the latch portion 68 also includes a hinge portion 90 which is appropriately hinged to the elongated element 70 about a hinge 92 and a hinge pin 93. The hinge 92, of course, would be formed on the end 82 of the elongated element 70.

Figure 7:
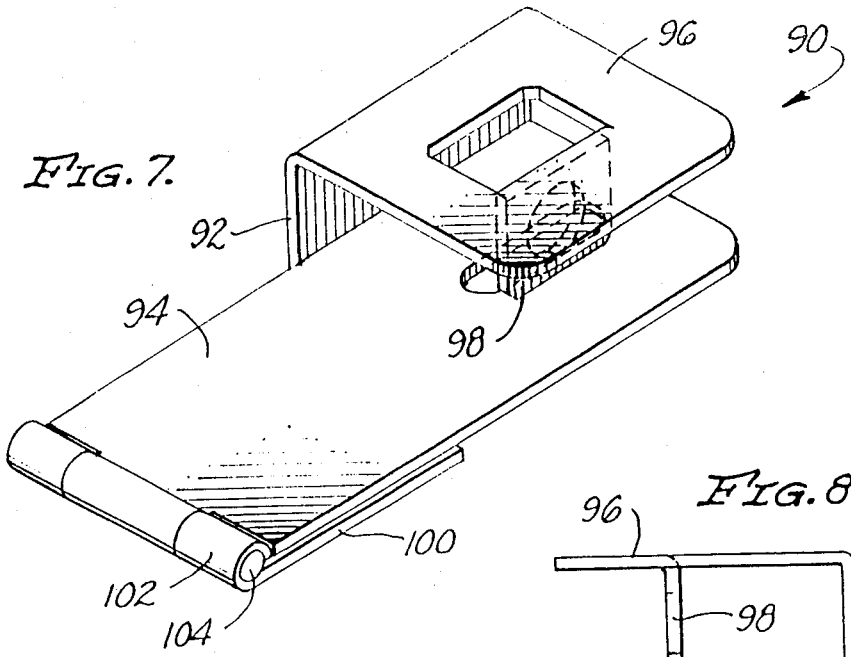
FIG. 7 is an alternate embodiment of the latch portion of a self protecting hasp similar to the hasp of FIG. 4.
Figure 8:
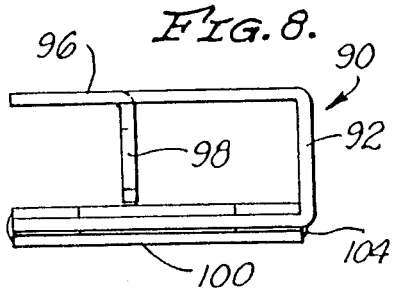
FIG. 8 is an end elevational view of the embodiment of FIG. 7.

In FIGS. 7 and 8 a further latch portion 90 of a self portecting hasp is seen. Not shown in FIGS. 7 and 8 is an eye portion 30. An identical eye portion as described above would be utilized in conjunction with the latch portion 90 of FIGS. 7 and 8.

A latch portion 90 of FIGS. 7 and 8 differs from the latch portion 68 of FIGS. 4, 5 and 6 in that instead of having a first section like the first section 82 on the end of the flap, a perpendicular section 92 is positioned along an edge which is perpendicular to a hinge. An appropriate second section, or parallel section 96 is connected to the first or perpendicular section 92. The parallel section 96 further includes a latch eye 98 identical to the previous latch eyes described. The latch portion 90 is completed via a hinge plate 100 and a hinge 102 and hinge pin 104.

Since hasps are normally located on two structures such that they open by moving along a horizontal line, the embodiments of FIGS. 1 through 6 are universal in being able to be used on both a right hand and a left hand opening hasp. If used in a horizontal manner the embodiments of FIGS. 7 and 8 would require a left hand model and a right hand model in order to prevent the first section 92 from being positioned in a downward direction if the embodiment of FIG. 7 was rotated 180°. However, for use where a hasp will be opened along a vertical line the embodiments of FIGS. 7 and 8 allow for placement of the latch portion 90 either as the bottom component or the top component and still allow the padlock to drape downwardly. Thus the embodiment of FIGS. 7 and 8 might find its greatest utilitarian use when used as a vertically oriented hasp.

Figure 9:
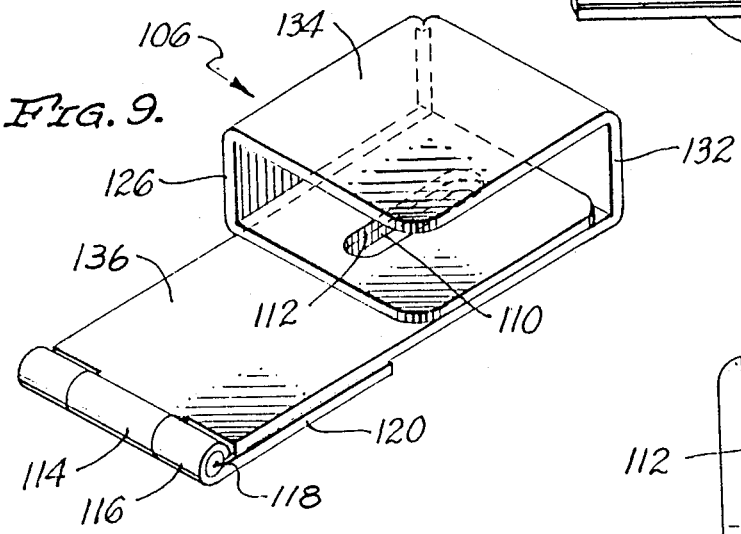
FIG. 9 is even a further embodiment of the latch portion of a self protecting hasp of the invention.

In a further embodiment shown in FIG. 9 a latch eye is not utilized. Instead a further retaining wall is utilized. In this embodiment a latch portion 106 is formed and is adapted to be used with the same above described eye portion 30.

Figure 10:
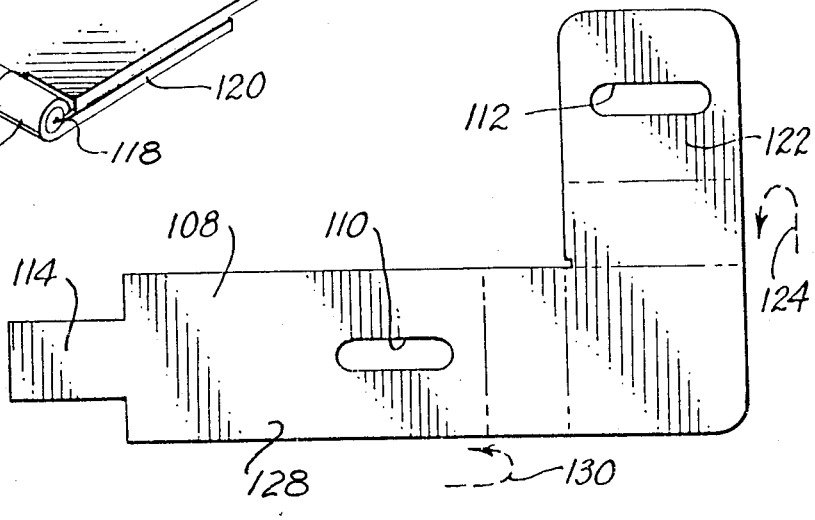
FIG. 10 is a plan view of a portion of the structure of FIG. 9 as it would be seen prior to final shaping of that portion as seen in FIG. 9.

To construct the latch portion 106, a plate 108 shown in FIG. 10 is stamped or appropriately cut. It includes a first slot 110 and a second slot 112 formed therein. It further includes a tab 114 which will be utilized to form portions of a hinge 116 which will be utilized via a pin 118 to attach to a hinge plate 120.

Referring to FIG. 10 the plate 108 is formed in a somewhat "L" shape. To form the latch portion 106 the short leg 122 of this "L" form is first formed back on itself as per the phantom arrow 124. This forms a first wall 126 as seen in FIG. 9. Next the long leg 128 is bent in a manner as described by the phantom arrow 130. This forms a second wall 132. In doing this this positions the slot 112 over the slot 110.

The cover member 134 so formed in bending the plate 108 as described above is now retained to the flap portion 136 via two walls, the wall 126 and the wall 132.

Thus the cover member 134 is fixed to the flap 136 on two sides. This inhibits bending of the cover member 134 to prevent access to a padlock which would be attached to an eye which would pass through both the slot 110 and the slot 112.

As with the embodiment of FIGS. 7 and 8 the embodiment of FIG. 9 would also yield a right hand and a left hand model.

For all of the embodiments described, once punched, bent and formed all of the components forming the respective flaps, cover members and latch eyes can be case hardened to further insure for security in use of these self protecting hasps. Further, as a general rule the cover members will be formed slightly oversized with respect to the portions of the flaps which they overlay to insure that the cover members extend completely over the shank portions of locks which will be utilized in conjunction with these respective self protecting hasps.

While in the embodiments of the FIGS., two 90° bends were utilized in forming the cover members and positioning them over the respective flaps, a single round bend could also be utilized to shape these respective components.

Figure 11:
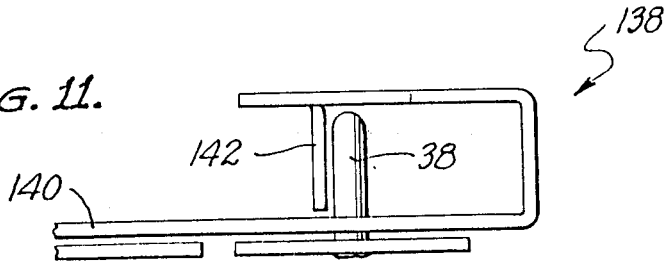
FIG. 11 is an further embodiment the latch portion of a self protecting hasp similar to the hasp of FIG. 4.

In FIG. 11 a further embodiment similar to the embodiment of FIG. 4 is illustrated. In this embodiment, a self protecting hasp 138 is illustrated. It differs from the hasp 66 of FIG. 4 in that the eye 38 is orientated 90° with respect to the orientation of the eye of FIG. 4.

The latch portion 140 of the hasp 138 has latch eye 142 which is also orientated 90° with respect to the orientation of the latch eye of FIG. 4. With the exception of the orientation of the latch eye 142 and consequently the orientation of the eye 38, the hasp 138 is in all other respects identical to the hasp 66. However, as can be seen in comparing the hasp 68 and 138, a self protecting hasp can be constructed which will accommodate the orientation of the eye 38 either horizontal as in the hasp 66 or vertical as in the hasp 138.

As is evident from the above description and the figures, each of the self projecting hasps of the invention include a cover member which inhibits access to the slot area of the hasp and thus access to a padlock shank which would be utilized to lock an eye through that slot. Further, the self protecting hasps of the invention utilize a means, as for instance the latch eyes of the embodiments of FIGS. 1 through 8 and the dual walls of the embodiment of FIG. 9, to inhibit prying or bending of the cover member away from the slot area of the flap. This, thus serves to provide a highly utilitarian set of self protecting hasps of the invention.

I claim:

1. A self protecting hasp for use with a padlock which comprises:

an eye, said eye including means for attaching said eye to a structure;

a latch for engaging with said eye, said latch including a hinge portion, said hinge portion including means for attaching said latch to a structure;

said latch further including a flap, said flap including a slot for engaging said eye, said flap movably connecting to said hinge portion;

a cover member having side edges, said cover member fixedly connected to said flap, a portion of said cover member sized and shaped to overlay and cover at least that portion of said flap wherein said slot is located;

a latch eye fixedly connected to said cover member at a location spaced inwardly from said side edges of said cover member and extending essentially perpendicularly from said cover member towards said slot in said flap whereby said latch eye aligns with said eye when said eye is positioned in said slot and is capable of being locked to said eye with a padlock when said padlock is positioned between said flap and said cover member.

2. The hasp of claim 1 wherein:

said cover member includes a first section and a second section, said first section located in association with said flap and extending from said flap, said second section located in association with said first section and extending from said first section essentially parallel to said portion of said flap wherein said slot is located to overlay said section of said flap wherein said slot is located.

3. The hasp of claim 1 wherein:

said latch eye comprises a latch member integrally attached to and extending from said cover member.

4. The hasp of claim 3 wherein:

said latch member is formed from said cover member by cutting a slot in said cover member wherein said slot defines the outside periphery of said latch member except for a joining edge thereof and bending said latch member amount said joining edge downward from the remainder of said cover member such that said latch member is positioned essentially perpendicular to the remainder of said cover member.

5. The hasp of claim 1 wherein:

said cover member is formed as a first component and said flap is formed as a second component, said first component fixedly joined to said second component to integrally connect said cover member to said flap.

6. A self protecting hasp for use with a padlock which comprises:

an eye, said eye including means for attaching said eye to a structure;

a latch for engaging with said eye, said latch including a hinge portion, said hinge portion including means for attaching said latch to a structure;

said latch further including a flap, said flap including a slot for engaging said eye, said flap movably connecting to said hinge portion;

a cover member fixedly connected to said flap, a portion of said cover member sized and shaped to overlay and cover at least that portion of said flap wherein said slot is located;

a latch eye fixedly connected to said cover member and extending from said cover member towards said slot in said flap whereby said latch eye aligns with saisd eye when said eye is positioned in said slot and is capable of being locked to said eye with a padlock when said padlock is positioned between said flap and said cover member;

said cover member and said flap comprise an elongated integral element having ends and an intermediate portion located between said ends, said elongated element movably attaching to said hinge portion of said latch at one of its ends, said elongated element including at least one bend wherein the other end of said elongated element is bent back over said intermediate portion of said elongated element to form an essentially parallel section of said elongated element, said bend dividing said elongated element into sections, one of said sections located in between said bend and said one of said ends, the other of said sections located in between said bend and the other of said ends, said slot located in said one of said sections located between said bend and said one of said ends.

7. The hasp of claim 6 wherein:

said latch eye is fixedly positioned on said elongated element on said other of said sections, said latch eye projecting towards said slot to align with said eye and be capable of being locked to said eye with a padlock.

8. A self protecting hasp for use with a padlock which comprises:

an eye, said eye including means for attaching said eye to a structure;

a latch for engaging with said eye, said latch including a hinge portion, said hinge portion including means for attaching said latch to a structure;

said latch further including a flap, said flap including slot means for engaging said eye, said flap movably connecting to said hinge portion;

a cover member, said cover member including a first section and a second section, said first section integrally connected to said flap and extending from said flap, said second section integrally connected to said first section and extending from said first section essentially parallel to said flap and spaced from and overlaying a section of said flap wherein said slot means is located, said second section having side edges;

a latch eye; and said latch eye fixedly positioned on said second section of said cover member inwardly from said side edges and projecting towards said slot means to align with said eye and be capable of being locked to said eye with a padlock.

9. The hasp of claim 8 wherein:

said latch eye comprises latch member integrally attached to and extending from said second section of said cover member.

10. The hasp of claim 9 wherein:

said latch member is formed from said second section of said cover member by cutting a slot in said second section of said cover member wherein said slot defines the outside periphery of said latch member except for a joining edge thereof and bending said latch member about said joining edge downward from the remainder of said second section of said cover member such that said latch member is positioned essentially perpendicular to the remainder of said second section of said cover member and is also positioned essentially perpendicular to said flap.

11. A self protecting hasp for use with a padlock consisting of:

an eye, said eye including means for attaching said eye to a structure;

a latch for engaging with said eye, said latch including a hinge portion, said hinge portion including means for attaching said latch to a structure;

said latch including a flap, said flap having a slot located therein for engaging said eye, said flap movably connecting to said hinge portion;

said latch further including a cover member, said cover member fixedly attaching to said flap, said cover member including a perpendicular section and a parallel section, said perpendicular section extending from said flap, said parallel section connecting to said perpendicular section and extending parallel to said flap in a spaced relationship with said flap, said parallel section having side edges;

a latch eye fixedly positioned on said parallel section of said cover member in a location spaced inwardly from said side edges and projecting essentially perpendicular from said cover member toward said slot in said flap so as to be positioned in association with said slot and to align with said eye when said slot engages said eye whereby said latch eye is capable of being locked to said eye with a padlock.

12. The hasp of claim 11 including:

said latch eye comprises a latch member integrally attaching to and extending from said parallel section of said cover member; and said latch member is formed from said parallel section of said cover member by cutting a slot in said parallel section of said cover member wherein said slot defines the outside periphery of said latch member except for a joining side thereof and bending said latch member about said joining edge downward from the remainder of said parallel section of said cover member such that said latch member is positioned essentially perpendicular to the remainder of said parallel section of said cover member and is also positioned essentially perpendicular to said flap.

13. A self protecting hasp for use with a padlock consisting of:

an eye, said eye including means for attaching said eye to a structure;

a latch for engaging with said eye, said latch including a hinge portion, said hinge portion including means for attaching said latch to a structure;

said latch further including an elongated integral element having ends and an intermediate portion located between said ends, said elongated element movably attaching to said hinge portion of said latch at one of its ends, said elongated element including at least one bend wherein the other end of said elongated element is bent back over said intermediate portion of said elongated element to form an essentially parallel section of said elongated element, said bend dividing said elongated element into sections, one of said sections located between said bend and said one of said ends, the other of said sections located between said bend and the other of said ends;

a slot located in said one of said sections located between said bend and said one of said ends, said slot for engaging with said eye;

a latch eye fixedly positioned on said elongated element on the other of said sections, said latch eye projecting towards said slot to align with said eye and being capable of being locked to said eye with a padlock.

14. The hasp of claim 13 including:

said latch eye formed as a latch member integrally attaching to and extending from said other section of said elongated element and extending toward said one of said sections located between said bend and said one of said ends; and said latch member formed in said other of said sections of said elongated element by cutting a slot in said other section of said elongated element wherein said slot defines the outside periphery of said latch member except for a joining edge thereof and bending said latch member about said joining edge downward from the remainder of said other of said sections of said elongated element such that said latch member is positioned essentially perpendicular to the remainder of said other of said sections of said elongated element and is also positioned essentially perpendicular to said one of said sections of said elongated element.

* * * * *

UNITED STATES PATENT AND TRADEMARK OFFICE

CERTIFICATE OF CORRECTION

PATENT NO. : 4,852,920

DATED : AUGUST 1, 1989

INVENTOR(S) : WILLIAM DE FORREST, SR.

It is certified that error appears in the above-identified patent and that said Letters Patent is hereby corrected as shown below:

Column 4, line 10, "palte" should be --plate--.

Column 7, line 42, "projecting" should be --protecting--.

Column 8, line 27, "amount" should be --about--.

Column 8, line 55, "saisd" should be --said--.

Column 9, line 39, insert an --a-- between "comprises" and "latch".

Signed and Sealed this

Sixteenth Day of October, 1990

*Attest:*

HARRY F. MANBECK, JR.

*Attesting Officer*

*Commissioner of Patents and Trademarks*